United States Patent [19]

Viehe

[11] 4,324,017

[45] Apr. 13, 1982

[54] ROTARY DEVICE FOR TREATING WORK SURFACES

[76] Inventor: John S. Viehe, 692 Talamini Rd., Bridgewater, N.J. 08807

[21] Appl. No.: 187,714

[22] Filed: Sep. 16, 1980

[51] Int. Cl.[3] ..... A46D 9/02

[52] U.S. Cl. ..... 15/198; 15/236 C

[58] Field of Search ..... 15/179, 197, 198, 236 C

[56] References Cited

U.S. PATENT DOCUMENTS

| | | | |
|---|---|---|---|
| 188,132 | 3/1877 | Haskins | 15/198 |
| 1,475,074 | 11/1923 | McLaughlin | 15/179 |
| 1,583,587 | 5/1926 | Flynn | 15/198 X |
| 3,958,294 | 5/1976 | Thompson | 15/198 |
| 4,106,193 | 8/1978 | Fisher et al. | 15/236 C X |
| 4,183,113 | 1/1980 | Fusco | 15/236 C |
| 4,200,947 | 5/1980 | Ali | 15/198 |
| 4,229,912 | 10/1980 | Laughlin | 15/198 X |

*Primary Examiner*—Chris K. Moore
*Attorney, Agent, or Firm*—Jacob B. Burke

[57] ABSTRACT

A rotary device for treating a work surface comprises a generally cylindrical hub body having a closed end wall, an open other end, and a rather serpentine endless peripheral wall formed with smoothly merging cylindrical wall sections, curved wall sections, flat wall sections and inner cylindrical wall sections. The flat wall sections define channels and the inner cylindrical wall sections define sleeves for removably receiving interchangeable springy fingers with cylindrical knuckles at their inner ends in side-by-side array axially of the hub body. Free ends of the springy fingers extend chordally outward from the hub body in directions opposite to the direction of rotation of the hub body. A centrally apertured cover plate closes the open end of the hub body. A bolt extends axially through a central passage in the hub body. The bolt has a keyed head mating nonrotatably with a corresponding keyed end of the central passage to insure insertion of the bolt in correct axial direction in the hub body. A nut engages on the threaded end of the bolt and bears against the cover plate to hold the springy fingers in the hub body. The curved wall sections provide wide bearing surfaces for the springy fingers when they flex upon application to the work surface, and upon release from the work surface as the hub body rotates. The springy fingers can be made of wire which is round, oval or flat in cross section. The nut is reverse threaded to tighten when the device is under load in use. A cylindrical grinding wheel or sandpaper tube having inwardly extending springy fingers can be mounted on the hub body enclosing it, to rotate with the hub body. Hard or soft pads can be applied to the springy fingers for performing different functions.

14 Claims, 11 Drawing Figures

FIG. 1
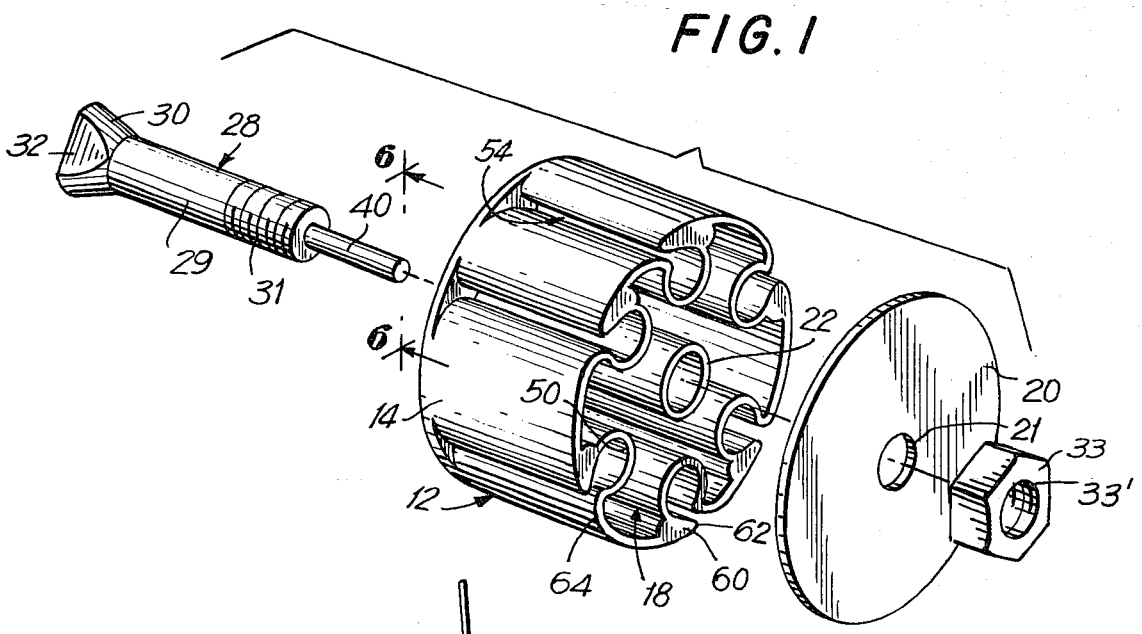
FIG. 2
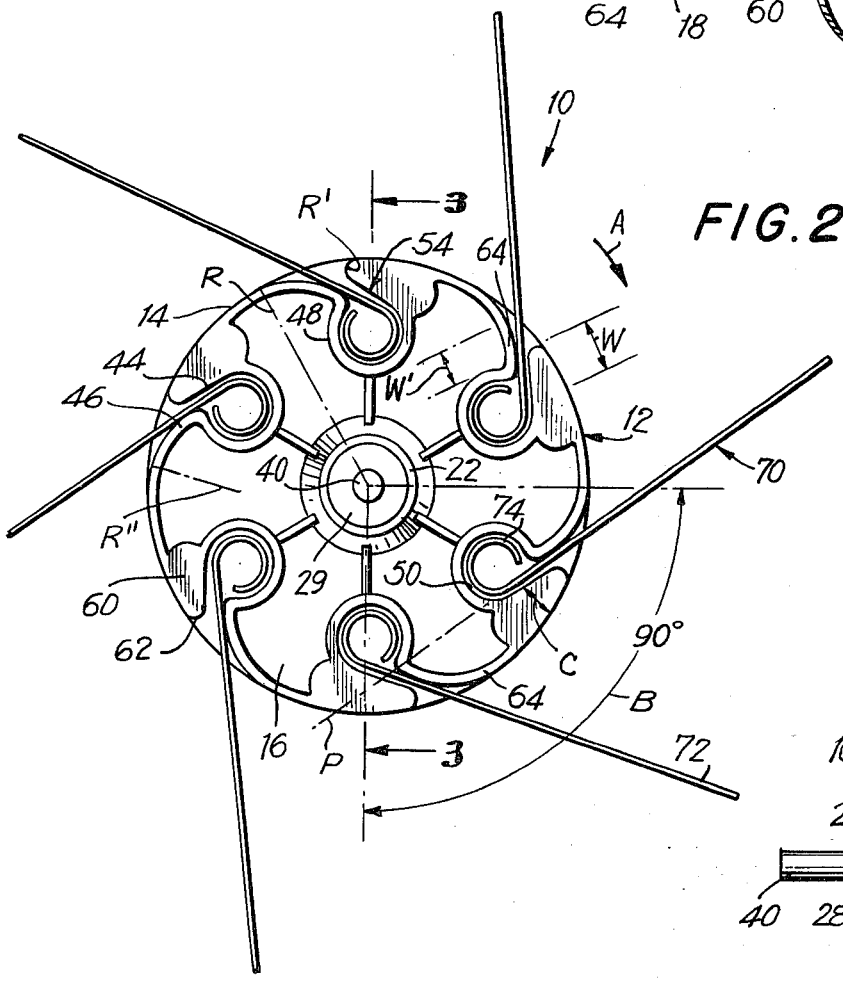
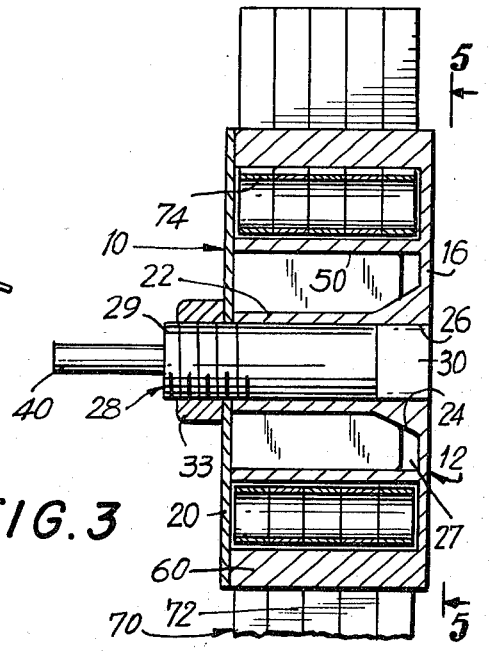
FIG. 3

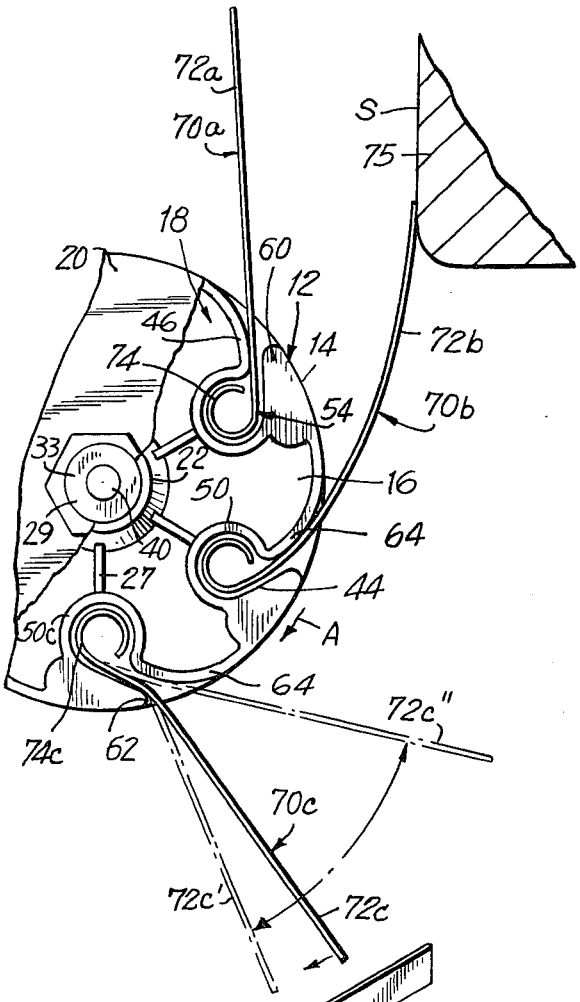
FIG.4
FIG.5
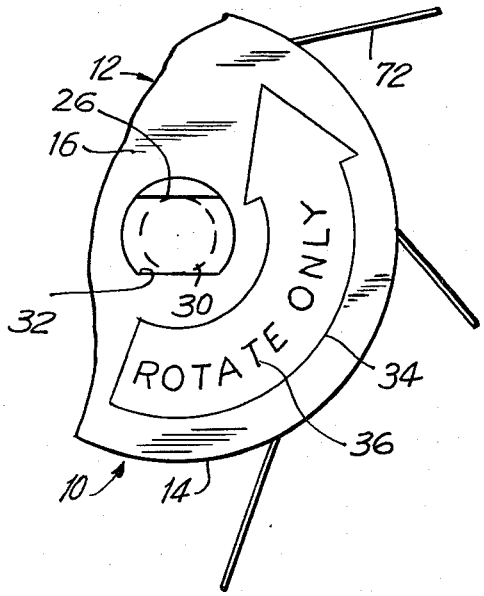
FIG.7
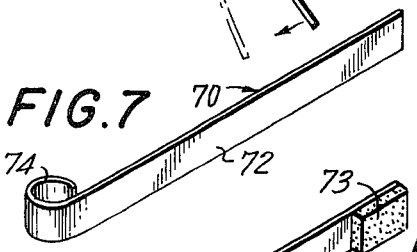
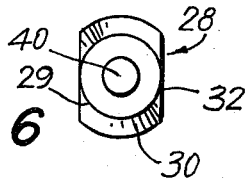
FIG.6
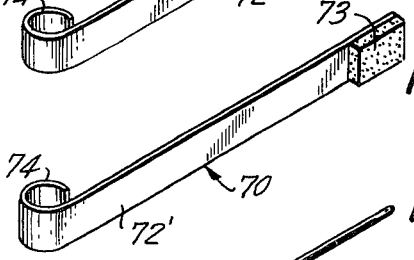
FIG.8
FIG.9
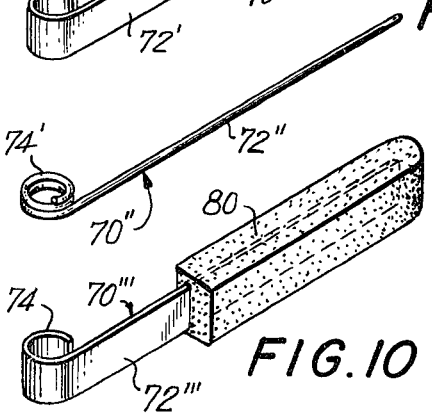
FIG.10
FIG.11
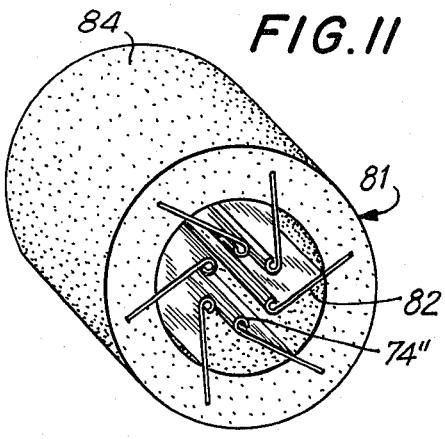

ROTARY DEVICE FOR TREATING WORK SURFACES

FIELD OF THE INVENTION

This invention relates to rotary devices for treating work surfaces, and more particularly concerns a rotary scraper of the type in which replaceable springy fingers extend from a central rotating hub to treat a surface.

BACKGROUND OF THE INVENTION

Rotary scrapers are well known devices for treatment of a work surface, particularly those scrapers employing springy wire elements. In conventional rotary scrapers, the wire elements are pivotably mounted about a shaft which is parallel to the rotational axis of a hub of which the shaft is a part. Upon hub rotation, the wire elements strike and abrade the work surface with sufficient force to remove surface material. United State Patents on various forms of such rotary scrapers have issued; see for example: U.S. Pat. Nos. 188,132 to Haskins; 674,384 to Nash; 1,475,074 to McLaughlin; 1,694,018 to Mudge et al; 1,856,299 to Alphen; 2,523,319 to Middlestadt; 2,990,884 to Hall et al; 3,061,860 to Bennett; and 3,958,294 to Thompson.

All the rotary scrapers described in the above patents have flexible scraper elements with rather short working lives. The flexible or bladelike elements break when they are repeatedly flexed at high speed during used of the scraper in close proximity to a working surface over an extended period of time. Their working lives are too short for heavy duty industrial use. In many of the prior scrapers it is difficult or impossible to interchange and replace a broken springy element. In almost all the prior scrapers it is difficult or impossible to interchange the springy elements with others of different widths and thicknesses to perform different functions. Prior scrapers lack versatility since they cannot quickly and easily be adapted to perform different functions such as polishing, brushing, light duty abrading, heavy duty scraping, surface preparation for painting, etc. Some prior scrapers are limited to use on certain materials such as wood, metal, or concrete. When used for scraping surfaces for which the prior scrapers are not designed, they gouge the surfaces, remove excess material or not enough material, and generally perform unsatisfactorily.

SUMMARY OF THE INVENTION

The present invention is directed at overcoming the above and other difficulties and disadvantages of the prior rotary scrapers employing flexible elements for abrasion of a work surface.

A principal object of the invention is to provide a versatile rotary scraper device adapted by use of interchangeable springy fingers to perform all of the following listed functions and many others:

1. Painting—to remove rust, varnish and loose paint from surfaces prior to painting, to remove gloss prior to applying second coats; and other pre-painting uses.

2. Manufacturing—to clean storage tanks, machines, floors, etc.; for deburring castings, and other in-process applications.

3. Agriculture—to clean silos inside and out, manure spreaders and other farm equipment, to prepare fences, barns, etc. for painting, and other uses.

4. Boating—to clean rust, loose paint and barnacles from boat bottoms and hulls, and other uses around marine equipment.

5. Swimming pools—to prepare concrete prior to painting, to remove stains, etc.

6. General household applications—to clean loose paint prior to repainting, to prepare floors for varnishing, to remove grass clippings from mowers, to remove rust from outdoor furniture, swing sets, etc.; and many other household uses.

7. Automotive—to remove caked-on grease from floors, engine blocks, transmissions, etc.; to prepare body work for finishing; and other applications.

8. Construction—to prepare concrete surfaces and for finishing; to clean construction equipment and tools; and other uses at construction sites.

9. Utilities—to remove rust from outdoor steel structures; for plant maintenance and many other uses at utility installations.

Prior rotary brushes and scrapers have not been capable of performing all the above listed functions by use of just one tool, so that users must provide a multiplicity of scraper tools to perform all these functions. In the present invention, by contrast, just one tool performs all the listed functions and many more. This one light weight, relatively inexpensive tool of simplified but improved construction has a longer useful working life than comparable tools having less versatility. The present tool uses less material and parts in its fabrication, and can be manufactured more economically. The tool converts quickly and easily from performing one function to another as different springy fingers are placed in the tool.

According to the invention there is provided a heavy duty rotary scraper which can be used for abrading or scraping away hard or soft material from a work surface, at high speed without gouging the work surface. Springy wire or blade fingers are removably mounted in a hub of the tool. The fingers have cylindrical knuckles removably engaged in cylindrical sleeves inside the cylindrical hub. The hub is a hollow, lightweight metal casting rather than a heavy solid massive body as has heretofore been used. The hub has a closed integral end wall and an open opposite end closed by a removable cover plate. The plate can be quickly removed to expose the springy fingers. A plurality of springy fingers are loosely fitted in side-by-side coplanar array in each of a plurality of circumferentially spaced channels communicating with the cylindrical sleeves. The springy fingers can be easily and quickly removed and interchanged with others of different width and thickness. Wire fingers can be interchanged for blade elements. Fingers of round or flat cross section can be interchanged for others of oval cross section.

The springy fingers extend through the channels in the hub and extend chordally outwardly. A particular important feature of the invention is the unique curvatures of the opposing or side walls of the channels at their outer ends from which the springy fingers extend. These walls are broad, extending almost the full axial length of the hub. They provide support for the springy elements both when they are flexed to apply abrading force to a work surface and when they snap back and oscillate on turning free from the work surface. The ends of the springy fingers can be provided with hard carborundum or aluminum oxide tips to remove surface material fast. The springy fingers enable the rotary scraper assembly to operate at high speeds against heavy work loads for long periods of time without breaking the springy fingers or damaging the rotary hub. Prior rotary scrapers could not fulfill these heavy duty operational requirements.

In the present invention, the hub is provided with a removable axial shaft or bolt having a head of unique shape which can be fitted in only one way into a keyed socket in the fixed end wall of the hub. The head of the bolt fits snugly in this socket while the shank of the bolt extends through an axial sleeve in the hub. This arrangement insures that the bolt and hub cannot rotate with respect to each other. Furthermore the mating keyed structure insures that the bolt or shaft extends laterally of the hub in proper direction axially for rotating the hub and springy fingers in proper direction circumferentially. Since the bolt is removable it can readily be replaced if damaged. A single removable nut securely holds the axial bolt and removable end cover plate in place. The cover plate holds the spring fingers in the hub.

In accordance with the invention, springy fingers terminating in cylindrical knuckles are disposed in side-by-side positions in the hub body which is so shaped as to allow the fingers to bend over long angular distances to facilitate working close to a work surface. The hub is so shaped as to support the fingers at their extremes of bending, thereby preventing metal fatigue and breakage of the fingers during heavy duty use of the device. According to the invention, the hollow hub body is provided with a serpentine peripheral wall which has outer sections smoothly merging into curved finger supporting sections which merge into flat, spaced wall sections defining channels for guiding the springy fingers, and the flat wall sections smoothly merge into cylindrical sleeves in which the knuckles of the fingers are engaged. The channels are oriented chordally more than in prior rotary scrapers so that the fingers extend chordally outwardly and operate more efficiently than prior rotary scrapers when rotated in only one direction. Blunt leading edges of wedge shaped formations of the hub walls allow the springy fingers to snap forwardly and oscillate after leaving the work surface without bearing on sharp channel corners and thus avoiding metal fatigue and breakage of the fingers. Prior rotary scrapers do not employ this construction. Curved trailing sections of the channel walls without sharp corners fully support the springy fingers at points of maximum stress and flexure when they are bent backwardly while bearing on the work surface, so that fingers will not break even when subjected to heavy duty use at high speeds over long periods of working time. Prior rotary scrapers do not have this construction.

Further in accordance with the invention, the hub is reduced in weight by making the interior of the hub hollow but sufficiently rigid to withstand heavy stresses during use. The serpentine peripheral wall of the hub has outer cylindrical wall sections, curved finger supporting wall sections, flat guide wall sections and cylindrical knuckle engaging wall sections. Leading flat guide wall sections define wedge-shaped members having rounded apices to support the springy fingers after they leave the work surface. Trailing curved wall sections support the flexed fingers while abrading the work surface. The fingers are loosely fitted in the cylindrical sleeves and straight channels so they can turn angularly slightly to bear against the proper bearing wall surfaces during use. The loose fit of the fingers also facilitates easy removal and replacement of different fingers for performing different functions.

The improved hub is an accurately balanced unitary casting. Applied to the open side of the hub is the end cover plate. A nut bears on this plate engaging a threaded portion of the axial bolt and holding the springy fingers in the hub.

It is therefore another object of the invention to provide a rotary surface working device employing replaceable, springy, surface treating elements, which device is of light weight, durable, reliable, and safe construction, easier to assemble, employing fewer parts than prior rotary scrapers, more economical to manufacture, and having a longer useful life than prior rotary scrapers.

These and other advantages and objects of the invention will be better understood from the following detailed description of the invention taken together with the drawing.

BRIEF DESCRIPTION OF THE DRAWING

FIG. 1 is an exploded perspective view of parts of a rotary scraper embodying the invention, the springy fingers being omitted.

FIG. 2 is an end view of the assembled rotary scraper, the end cover plate and retaining nut being omitted and parts of the springy fingers being broken away.

FIG. 3 is a diametral axial sectional view taken on line 3—3 of FIG. 2, with parts of the springy fingers broken away.

FIG. 4 is a fragmentary end view similar to a portion of FIG. 2 showing a mode of operation of the rotary scraper.

FIG. 5 is a fragmentary opposite end view of the rotary scraper taken on line 5—5 of FIG. 3.

FIG. 6 is an end view of the retaining bolt taken on line 6—6 of FIG. 1.

FIGS. 7,8,9 and 10 are perspective views of different types of springy fingers.

FIG. 11 is a perspective view of a drinding member which can be used in the scraper.

DETAILED DESCRIPTION OF THE INVENTION

Referring now to the drawing, there is shown in FIGS. 1–5, a rotary scraper 10 having a hub body 12. The hub has an external generally cylindrical peripheral wall 14, an integral circular end wall 16, and an open end 18. A circular removable cover plate 20 closes the open end 18. Plate 20 has a central hole 21. Integral with closed end wall 16 is an axial cylindrical sleeve 22 whose axial length is equal to the internal axial length of hub 12. Sleeve 22 has a conical external end portion 24 integral at its wider end with wall 16. Chordal flat lands 26 are formed in conical sleeve portion 24; see FIGS. 1 and 2. Short radial ribs 27 reinforce wall 16 at sleeve end portion 24.

A shaft or bolt 28 has a cylindrical shank 29 extending through sleeve 22 and hole 21 in plate 20. The bolt has a threaded portion 31 at the end of the shank. The bolt has a conical head 30 formed with opposed parallel chordal flat lands or faces 32 which abut lands 26 in the outer end of sleeve portion 24. Sleeve portion 24 can be formed with only one land 26 if desired, in which construction sleeve 22 must have a thickened wall opposite from one land 26 to balance the hub in rotation. A hexagonal nut 33 engages on the threaded end 31 of shank 29 and bears against plate 20. An integral shaft 40 of reduced diameter extends axially from the threaded end of shank 29. This shaft projects axially outwardly of the hub for mounting the rotary scraper in a chuck of a drill (not shown) or other driving motor means. On the outside end of wall 16 is an arrow 34 and legend 36 indicating the proper direction of rotation of the rotary scraper during use. FIGS. 1 and 4 show shaft 40 extending axially from shank 29.

The outer wall of hub 12 is generally serpentine in configuration. It is formed with integral reentrant flat parallel walls 44 and 46 expanded at their inner ends to form cylindrically curved internal wall sections defining circumferentially spaced axial sleeves 50 integral with and closed at end wall 16; see FIGS. 1, 2 and 4. Opposite ends of the sleeves are open. The hub has six cylindrical sleeves spaced equally apart inside the hub and circumferentially thereof.

The structure and arrangement of walls 44 and 46 and sleeves 50 constitute important features of the invention. Each flat wall 44 in the direction of rotation of the hub indicated by arrow A in FIG. 2 is about twice as long as wall 46. The flat walls 44,46 are slightly spaced apart and define narrow flat chordally disposed channels 54 communicating with the axially disposed cylindrical recesses defined by sleeves 50. Each flat wall 44 in the direction of rotation of hub 12 as indicated by arrow A in FIG. 2 has a width W about twice that of wall 46. The chordal length of each channel 54 is such that each channel would subtend an angle B of 90° if extended by plane P to intersect wall 14; see FIG. 2. This plane may subtend an angle ranging from 45° to 120° so fingers 70 point in proper directions for treating work surface S.

Each wall 44 defines a wedge 60 with outer curved wall 14. The walls of the wedge define an angle C of about 30°. The apical end 62 of the wedge extends the full length of the wedge axially of the hub, and has a radius of curvature R′ of at least 1/16 of an inch. The narrow end 62 of each wedge circumferentially of the hub is directed opposite to the direction A of rotation of the hub; see FIG. 2. Each flat wall 46 at its outer end merges into a curved wall section 64 which has a radius of curvature R″ of not less than ¼ of an inch. The curved wall sections 64 are located at the trailing sides of channels 54, while the rounded apices 62 of wedges 60 are located at the leading sides of channels 54, in the direction A of rotation of the hub. Radius R″ has a length of about ⅓ of radius R of the hub. Thus for a radius R of about one and one half inches, radius R″ will be at least ½ inch. Radius R′ will be about ⅛ of radius R″. Thus for a radius R″ of at least ½ inch radius R′ will be at least 1/16 of an inch.

Springy fingers 70 have flat shafts 72 which are normally disposed in side-by-side array in channels 54 axially of hub body 12; see FIG. 3. The thickness of each shaft 72 is slightly less than the width of each channel 54 in a circumferential direction in the hub. Each finger 70 terminates in a cylindrically curved knuckle 74 whose diameter is slightly less than the internal diameter of each sleeve 50.

By the arrangement described, each springy finger 70 is angularly rotatable freely and without flexing in channel 54 and sleeve 50 about 10°, between abutments with wall 44 and 46. The springy fingers can be freely inserted into and removed from the hub because their shafts are thinner than channels 54 and their knuckles are smaller in diameter than the interiors of sleeves 50. The ability to rotate angularly is important in this invention as will be understood with reference to FIG. 4 which shows one finger **70*a* with straight shaft 72*a* approaching surface S of a piece of work 75 while hub 12 rotates in direction A. The shaft 72*a* abuts a trailing wall 46. Shaft 72*b* of the next finger 70*b* is wiping or scraping work surface S. The flexed finger 70*b* is bearing on the adjacent rounded, curved wall section 64, while the cylindrical knuckle bears against 44 of adjacent wedge 60, and is retained in adjacent sleeve 50. The next finger 70*c* in direction of rotation A whose springy shaft has just left work surface S has first sprung or snapped forwardly against the rounded apex 62 of wedge 60 to the dotted line position 72′ and has then rebounded to the solid line position shown in FIG. 4. The springy shaft oscillates between the dotted and solid line positions. The springy shaft has rotated between dotted line positions 72*c*′ and 72*c*″ while knuckle 74*c* rotates in sleeve 50*c*. Since wall sections 64 are cylindrical and have large radii of curvature R″, and since apices 62 of wedges 60** are rounded with radii R′, the fingers can flex numerous times without experiencing metal fatigue and breaking. In conventional rotary scraper devices where channels containing flexible fingers are substantially radial rather than chordal and terminate in sharp corners as shown in U.S. Pat. Nos. 188,132 and 1,475,074 above mentioned, flexure of the fingers repeatedly against the sharp corners will break off the fingers if the devices are rotated and used against work surfaces at high speeds and high torque.

The springy fingers preferably have the forms best shown in FIGS. 3 and 7. Each finger 70 has a long flat relatively wide springy shaft 72 terminating in a cylindrical knuckle at one end substantially tangential to the shaft. This form is ideally adapted for side-by-side coplanar disposition of the fingers as shown in FIG. 3, and will cut, abrade, scrape, smooth and/or clean a surface without gouging. The side-by-side disposition makes it possible to flex the fingers independently to conform them to a curved or irregular work surface. FIG. 8 shows a finger 70′ which is basically the same as finger 70, except that a thin pad 73 made of a hard abrading material such as carborundum or aluminum oxide is secured to the outer side of shaft 72′ at its free end to provide for faster, increased abrading action and longer working life. FIG. 9 shows finger 70″ made of wire which is round or oval in cross section. It has a straight springy shaft 72″ and a circularly curled springy knuckle at one end tangential to the shaft. Finger 70″ can be made of light or heavy gauge wire depending on the type of work to be performed. FIG. 10 shows a finger 70‴ on whose springy shaft 72‴ is mounted a polishing and finishing pad 80. All finger structures shown in FIGS. 7–10 can be used interchangeably in hub 12. A plurality of springy fingers can be inserted in side-by-side array axially of the hub in each sleeve 50 with the springy shafts extending through communicating channels 54 in coplanar array. The shafts all extend chordally out of the hub in a direction opposite to direction A of rotation of the hub. By interchanging one type of springy finger for another a variety of different functions can be performed as listed above, which functions cannot be performed by one type of finger alone. For examples, wire fingers 70′ can be used for light duty brushing, scrubbing, polishing and cleaning. Oval fingers made of copper berylium can be used for nonsparking industrial applications for stripping and cleaning. The fingers made of round wire can be made of spring steel such as piano wire in narrow or wide gauges for light and heavy duty work. Flat fingers 70 can be used for non-gouging, general purpose cleaning and stripping on wood, fiberglass, masonry and metals. Fingers ranging in thickness from 0.020 to 0.035 inches can be used for light duty work, and heavier fingers about 0.050 inches thick can be used for heavy duty work. The preferred width of all flat fingers 70, 70' and 70''' is about 0.250 inches. The carbide tipped fingers 70' can be used for non-gouging industrial cleaning and stripping on masonry and metals. Thinner fingers in general will be used for light duty work and thicker fingers for heavy duty work.

Bolt 28 can be inserted through sleeve 22 in only one direction so that shaft 40 projects out of the hub body at the side opposite closed end wall 16. Head 30 cannot be fitted in or through hole 21 in plate 20. By this arrangement it is insured that the hub and springy fingers will only rotate in the proper clockwise direction A as viewed in FIG. 4. In prior rotary brushes such as the above mentioned U.S. Pat. Nos. 188,132 and 1,475,074, it did not matter in which direction the device rotated, so that their axial retainer bolts could be inserted in either direction axially of the hub. This is not permissible in the present rotary scraper 10 which is intended to rotate in only one direction due to the chordal disposition of the fingers which position has been found most efficient for the uses intended. Rotation of device 10 in the direction opposite to direction A would break the fingers and damage the work, so the axial positioning of the bolt 28 is arranged to prevent improper rotation of the device. The head 30 of the bolt is keyed to the lands 26 in sleeve end 24. This important feature insures that the hub cannot rotate with respect to the shaft, and both must rotate with the motor driven chuck holding and driving the scraper device in direction A.

The nut 33 has left-hand or reverse threading 33' which tightens when screwed on the left-hand or reverse thread 31 of bolt 28, i.e. counterclockwise direction as viewed in FIG. 4. Thus the nut tends to tighten when the device is used and rotated in direction A. To loosen the nut for disassembly of the device, the nut will be turned in direction A with respect to hub body 12, while the hub body is held stationary.

FIG. 11 shows a cylindrical grinding wheel 81 in which are partially embedded inwardly extending, chardally disposed wide springy fingers 82. The widths of the fingers axially of the wheel are substantially equal to the lengths of channels 54 axially of the hub. Cylindrical knuckles 74'' are provided at the inner ends of the springy fingers. The fingers will slide easily into channels 54 axially of the hub 12, while knuckles 74'' slide easily into sleeves 50. The fingers are slightly turnable in the hub as described above in connection with FIG. 4. If greater flexibility is desired, narrow fingers like fingers 70 can be used in place of each wide finger 82. Wheel 81 has an outer rough surface 84 for grinding, cleaning, polishing or any other abrasive use. Grinding wheel 81 has an inside hole which is larger in diameter than hub body 12 to extend around the hub body. Grinding wheel 81 can be quickly interchanged with any of the springy fingers shown in FIGS. 7–10. If desired, wheel 81 can be provided with an adhering sandpaper sleeve or cover for use of the device for sanding purposes. Alternatively, a cylindrical tube like wheel can be provided with a sandpaper outer cover. The tube will be secured to internally extending springy fingers 70 arranged as shown in FIG. 11 for engagement in channels 54.

Having thus described a rotary device for treating a work surface in accordance with the invention, its advantages can now be fully understood. A light weight hub structure is provided for use with conventional hand-holdable drills. Surface treating elements made of springy steel piano wire, copper berylium wire, or steel strip wire used alone or carrying sanding, cutting, grinding, cleaning or polishing members, can be mounted in the hub for use. All surface treating elements can be quickly installed, replaced and interchanged with others. Variations from the embodiment described may occur to one skilled in the art without departing from the invention as defined in the following claims, and the claims are intended to cover such variations.

What is claimed is:

1. A rotary device for treating a work surface, comprising a generally cylindrical hub body having a central axis and adapted for rotation in one direction about said axis, said hub body comprising:

an integral closed end wall and an open opposite end, said closed end wall having a central opening;

an axial passage terminating at said central opening to receive an axial bolt for rotating said hub body; and a generally cylindrical, serpentine wall integral with said end wall and adapted to receive and support springy fingers in chordal positions with respect to said hub body, with said fingers extending outwardly in a direction opposite to said one direction of rotation, said serpentine wall having:

outer circumferentially spaced cylindrically curved first wall sections, outer curved second wall sections merging smoothly with said first wall sections to provide bearing surfaces for said springy fingers when applied to said work surface while said hub body is rotated in said one direction, inner flat third wall sections merging smoothly with said second wall sections defining guides for said springy fingers, and curved fourth wall sections merging smoothly with said third wall sections and defining inner cylindrical sleeves substantially tangential to said third wall sections for retaining in said sleeves knuckles at inner ends of said fingers.

2. A rotary device as defined in claim 1, wherein said hub body further comprises:

flat fifth wall sections smoothly merging with said fourth wall sections and disposed parallel to said third wall sections to define therebetween guide channels for receiving said springy fingers in coplanar side-by-side array axially within said hub.

3. A rotary device as defined in claim 2, wherein said guide channels are disposed in chordal planes each subtending between 45° and 120° of arc circumferentially of said hub body, so that said fingers are disposed in optimum positions chordally of said hub body and extending away from said one direction of rotation for treating said work surface.

4. A rotary device as defined in claim 2, wherein said hub body further comprises: curved sixth wall sections merging smoothly with said first and fifth wall sections to define rounded, blunt other bearing surfaces for said springy fingers when they flex free from said work surface and oscillate while said hub body is rotated in said one direction.

5. A rotary device as defined in claim 4, wherein said first and said fifth wall sections define wedge shaped abutments having said curved sixth wall sections at their apical ends disposed at leading sides of said guide channels in said one direction of rotation of said hub body, said curved second wall sections being disposed at trailing sides of said guide channels in said one direction of rotation of said hub body.

6. A rotary device as defined in claim 4, wherein said second wall sections each has a radius of curvature at least one third of the radius of said cylindrical hub body, and wherein said sixth wall sections each has a radius of curvature at least one eighth of said radius of curvature of each adjacent second wall section, so that said springy fingers are fully supported when flexed to treat said work surface and when released from said work surface while said hub body rotates.

7. A rotary device as defined in claim 2, further comprising a plurality of springy fingers disposed in said channels, flexible outer ends of said fingers extending chordally from said hub body, said fingers having cylindrical knuckles at inner ends thereof engaged in said sleeves, said fingers being angularly turnable so that said fingers alternately contact opposite sides of said channels at extremes of angular turning.

8. A rotary device as defined in claim 7, further comprising a cylindrical abrasion member secured to outer ends of said fingers to rotate with said hub for treating said work surface.

9. A rotary device as defined in claim 7, wherein said fingers are thinner than widths of said channels circumferentially of said hub body, said knuckles being smaller in diameter than said sleeves, to facilitate quick and easy removal and replacement of said fingers in said hub body, and to enable said fingers to turn between one flexed position contacting said second wall sections when treating said work surface, and another flexed position contacting said sixth wall sections when released from said work surface while said hub body rotates in said one direction.

10. A rotary device as defined in claim 9, wherein a plurality of said fingers are disposed in each of said channels in side-by-side array axially of said hub body, said fingers being independently bendable for effectively treating a work surface.

11. A rotary device as defined in claim 10, further comprising pads secured to said springy fingers for selectively cutting, abrading, cleaning and polishing said work surface.

12. A rotary device as defined in claim 10, wherein said fingers are made of wire which is non-circular in cross section to apply broad abrasive surfaces to said work surface when treating the same.

13. A rotary device as defined in claim 1, further comprising a bolt insertable axially of said passage, said bolt and said passage having mating key structures to hold said bolt non-rotatably in said passage, and to permit insertion of said bolt into said passage in only one axial direction in said hub body.

14. A rotary device as defined in claim 13, wherein said bolt has a threaded portion, and wherein said device further comprises:

a centrally apertured cover plate mountable on said open end of said hub body with said threaded portion of said bolt extending therethrough; and a nut engageable on said threaded portion of said bolt to bear against said cover plate for holding said bolt in fixed axial position in said hub body for retaining said springy fingers in said hub body, said nut and said threaded portion of said bolt being so threaded as to tighten said nut when turned on said bolt in a direction opposite to said one direction of rotation of said hub body, said bolt having an axial shaft extension adapted for engagement by a chuck of a drill to rotate said device.

* * * * *